United States Patent [19]

Tragl et al.

[11] 4,164,169

[45] Aug. 14, 1979

[54] AXIAL-PISTON MACHINE HAVING A CYLINDER DRUM AND A REVERSING DEVICE

[75] Inventors: Wilfried Tragl, Aschaffenburg; Franz Forster, Mühlbach, both of Fed. Rep. of Germany

[73] Assignee: Linde Aktiengesellschaft, Wiesbaden, Fed. Rep. of Germany

[21] Appl. No.: 836,852

[22] Filed: Sep. 26, 1977

[30] Foreign Application Priority Data

Sep. 24, 1976 [DE] Fed. Rep. of Germany ..... 2642901

[51] Int. Cl.[2] ..... F01B 13/04

[52] U.S. Cl. ..... 91/504

[58] Field of Search ..... 91/485, 491, 504–506

[56] References Cited

U.S. PATENT DOCUMENTS

| | | | |
|---|---|---|---|
| 3,096,723 | 7/1963 | Puryear | 91/485 |
| 3,518,919 | 7/1970 | Freeman | 91/491 |
| 3,657,970 | 4/1972 | Kobayashi | 91/485 |
| 4,034,650 | 7/1977 | Molly | 91/505 |

FOREIGN PATENT DOCUMENTS

| | | | |
|---|---|---|---|
| 1006663 | 10/1965 | United Kingdom | 91/505 |
| 1146966 | 7/1966 | United Kingdom | 91/485 |

*Primary Examiner*—William L. Freeh

*Attorney, Agent, or Firm*—Karl F. Ross

[57] ABSTRACT

An axial-piston machine, such as an axial-piston pump or an axial-piston motor, in which the cylinder drum is in engagement with an intermediate disk which bears, in turn, upon the housing and has a spherically curved surface whose center of curvature is spaced to the side of the axis of rotation of the drum at which the pressure passage communicates with the cylinder drum.

11 Claims, 1 Drawing Figure

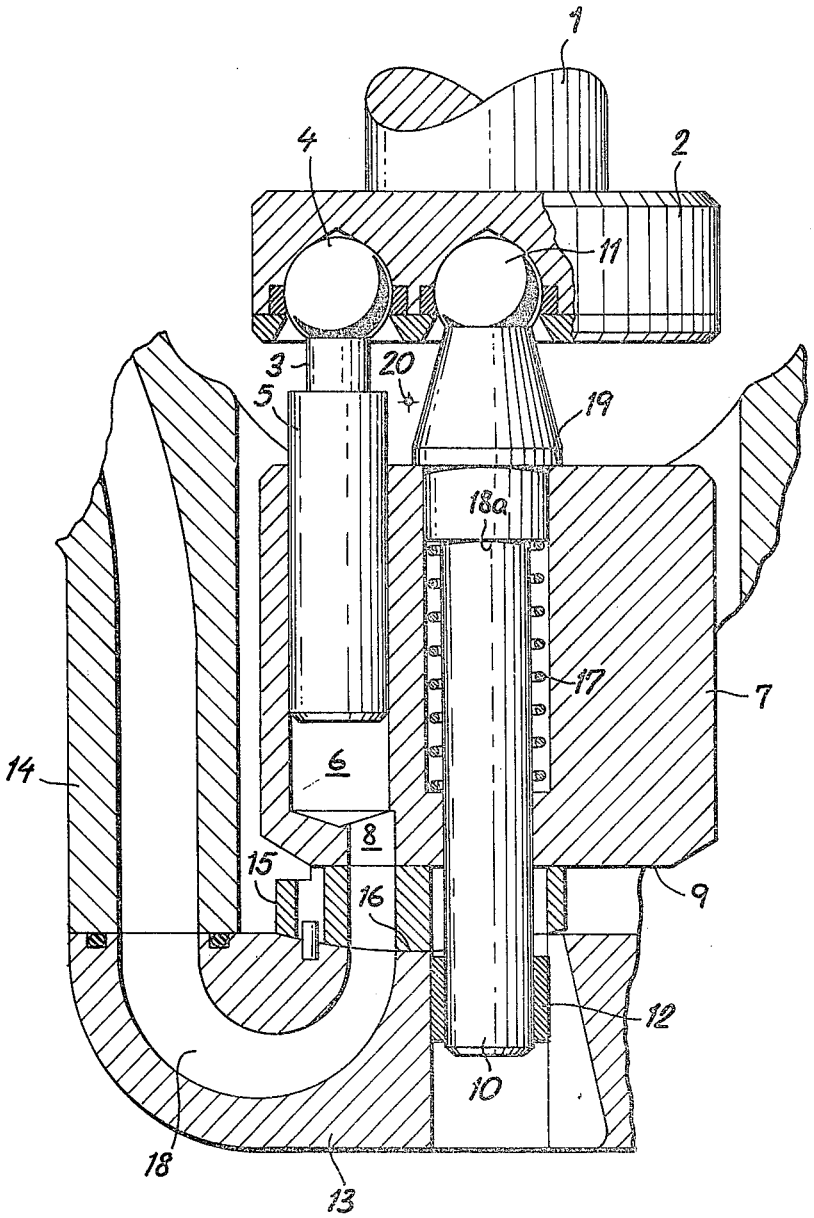
1
2
3
4
5
6
7
8
9
10
11
12
13
14
15
16
17
18
18a
19
20

AXIAL-PISTON MACHINE HAVING A CYLINDER DRUM AND A REVERSING DEVICE

FIELD OF THE INVENTION

The present invention relates to an axial-piston pump having a cylinder drum and a reversing device and, more particularly, to a pump or motor constituting an axial-piston machine in which the axis of rotation of the drum is fixed, i.e. is not tiltable relative to the housing.

BACKGROUND OF THE INVENTION

Axial-piston machines such as pumps and motors are known which have a cylinder drum journaled for rotation in a housing such that the journaling for the drum, which defines the axis of rotation thereof, is fixed relative to the housing, i.e. the cylinder drum is not free to tilt relative to the housing.

Such an axial-piston machine can have a reversing device between an end face of this cylinder drum and a housing portion provided with at least one pressurized-fluid passage, whereby between the cylinder drum and this housing portion an intermediate disk (control disk) is transversely shiftable. The control disk can have a side, turned toward the housing, with a spherical curvature bearing against a correspondingly shaped counter surface of the housing portion.

The cylinder can, for example, be journaled by a pair of radial bearings upon a central shaft which can be fixed in a pivotal housing in the case of a variable-displacement machine or in a fixed housing in the case of a nonadjustable machine. Alternatively, the drum can be journaled in this housing and in a drive flange of the axial piston machine or, in still another alternative, in the drive flange and in a swingable slide. In the latter case, the cylinder drum is swingable relative to the housing and is supported slidably thereagainst. The cylinder drum can, however, be journaled also by a pair of roller bearings directly in the housing.

In such machines, either the parts receiving the bearings and those carrying the reversing surface must be fabricated with high precision so that the reversing surface lies precisely perpendicular to the axis of rotation of the drum or the parts carrying the reversing surface must be given play or freedom to move.

In the previously known machines with such adjustability, the center of curvature of the spherically curved surface of the two spherically curved surfaces on both sides of the intermediate disk lie along the axis of rotation of the cylinder drum. Through the spherically curved surface, the fluid passages extend and open, because of the curvature of the surfaces, in a direction which is not perpendicular to the axis of rotation of the drum.

As a consequence, the pressure in these fluid passages applies a force to the intermediate disk which has a component radial to the axis of rotation. The fluid from the pressure passage enters the gap between the two surfaces so that, within this gap, a pressure field is generated.

The pressure is effective perpendicular to the surface so that a resultant force is generated which for each unit area is effective in the direction of the center of curvature so that this force can be resolved into a force parallel to the axis of rotation of the cylinder drum and into a force perpendicular thereto.

If the pressure force integrated over the entire surface is considered, these components are found to include resultant or net forces which are applied to the intermediate disk in a lateral direction, i.e. tending to laterally displace this disk.

Such forces must be counteracted in conventional machines by engaging the disk from the exterior laterally. Since these forces are dependent upon the pressure of the liquid, the counterforces must also be dependent upon the fluid pressure to minimize distortion moments on the disk. These counterforces must be generated by the pistons which are pressurized by the working fluid.

When the intermediate disk has convex spherical surfaces, the compensating forces must be applied to the side of the disk opposite that which is provided with the pressure passage so that expensive fluid-guide passages must be used.

The intermediate disk must be secured so that it is not entrained with the cylinder drum by friction forces. So that this tendency to rotatably entrain the disk by the drum does not apply significant force to the disk, which would result in transverse forces in addition to the axial pressure forces applied by the drum, relatively complex devices are needed to prevent entrainment. Such machines are described in Japanese patent JA-PS 690826 (47-43243) and French patent FR-PS 73.29921.

OBJECT OF THE INVENTION

It is the object of the present invention, in a special case of an axial-piston machine, to provide means whereby the auxiliary devices for providing the lateral compensating force are simplified and so that angularly adjustable control bases (bottoms) can be used at the intermediate disk which do not require complex precision machining and which are not more expensive to fabricate than the control plates of prior art machines as described above.

SUMMARY OF THE INVENTION

These objects are attained, in accordance with the present invention, in an axial-piston machine such as an axial-piston pump or an axial-piston motor which has a driven cylinder drum and a reversing device between an end face of the cylinder drum and a housing portion provided with a pressurized-fluid passage. Between the cylinder drum and this housing portion there is transversely shiftably mounted an intermediate disk which, at least on its side lying against the housing, is spherically curved and rides against a correspondingly shaped counter surface.

According to an essential of the invention, in an axial piston machine of this type in which the same side of the machine is provided with the reversing device and the pressurized-fluid passage, the center of curvature of the spherically curved surface on the housing side of the intermediate disk lies outside of the axis of rotation of the drum.

The invention thus translates the conventional solution using an intermediate disk with at least one spherical surface to the special case of an axial-piston machine in which always the same side is the fluid-pressure side, i.e. the fluid flows only in one direction and only one of the passages is continuously the pressure passage while the other passage or fitting of the machine is always the suction side.

This system differs from conventional intermediate disk configurations with concave spherical surfaces in which a simple direct pressure supply to the compensating-force pistons within the intermediate disk is possible, and has the advantage thereover that large transverse forces on the cylinder-drum bearings on the control flange side are avoided and fabrication is facilitated.

The invention is applicable to both inclined-disk or swash-plate machines and inclined-axis (drive flange) machines.

An inclined-disk or swash-plate axial-piston machine, according to the invention, is a machine of the type in which the piston heads of the axial pistons of the cylinder drum slide relative to the inclined reaction surface upon which they bear. In a drive-flange axial-piston machine, however, while the pistons bear against an inclined reaction plane, this plane rotates with the pistons and the cylinder drum although about an axis which is inclined to the axis of the drum.

According to a particularly preferred embodiment of the invention, the center of curvature of the spherical surface—in the case of a control disk which has a planar surface turned toward the cylinder drum and the spherical surface turned toward the housing—lies along the force line of action of the mean force which is exerted by the cylinder drum upon the planar surface of the intermediate (control) disk.

The pressure field arising from hydraulic fluid fed at the spherical contact surface of the disk is so shaped that its centroid (i.e. the center of gravity of the pressure-field surface) lies precisely along the same force line of action so that all uncompensated forces are applied centrally to the contact surface.

According to a further feature of the invention, the spherically curved surface of the intermediate plate is convex (i.e. a raised dome). The center of curvature of the spherically curved surface is, as has been mentioned previously, always offset to the side of the axis on which the fluid-pressure passage is provided in the plate and the housing.

In an embodiment of the invention in which the axial-piston machine is formed with an internal chamber of the housing surrounding the drum, it has been found to be advantageous to permit a part of the end face of the cylinder drum, whose cylinders are at the suction side (in the case of a pump) or the low-pressure discharge side (in the case of a motor) to remain unobstructed by the intermediate or control (valve) plate. Thus the latter side of the drum can simply overhang beyond the control plate.

When the face of the control plate in contact with the end face of the drum is planar, it has been found to be advantageous to have the center of curvature of the spherical surface lie along a perpendicular to this planar surface.

Advantageously, the journaling of the cylinder drum is effected, preferably via a central pin or shaft, with abutment means, e.g. a shoulder on the shaft, to prevent the drum from lifting away from the contact surface and the control plate.

The center of curvature of the spherically curved surface can lie in a plane which includes the axis of rotation of the drum and extends through both separating webs of the reversing device.

In general, the invention also provides for a drive-flange axial-piston machine which has an element intermediate the cylinder drum and the housing and which has a continuously curved surface contacting and lying against a correspondingly shaped (complementary) surface of the housing and whose axis lies along the tilting axis of the cylinder drum. The latter surface can be convex.

The intermediate disk can bear against this intermediate element with a spherical surface of the intermediate disk whose center of curvature lies outside the axis of rotation of the drum and at least approximately in the plane through the axis of rotation and the tilting axis.

This intermediate element can be simultaneously formed as the intermediate disk or plate and the center of curvature of the spherical surfaces of the intermediate plate and the housing can lie near the axis of rotation of the cylinder drum in the tilting axis thereof.

The intermediate disk at its side facing the housing can have a toroidally curved surface such that the annular center lies along the tilting axis of the drum and the center of curvature in the plane perpendicular to the annular plane lies near the axis of rotation of the drum between the tilting axis and the housing.

Such part of the intermediate disk (control plate) which would normally be provided to lie against the pressureless side (suction side) of the cylinder drum can be omitted (cut away) when the inner chamber of the axial-piston machine forms a plenum, in the case of a pump, from which the cylinder bores draw fluid or, in the case of a motor, into which fluid is discharged as pressure is relieved.

Thus the intake, in the case of a pump, and the discharge in the case of a motor, takes place directly into a chamber surrounding the drum without traversing any valve plate or control passage.

This arrangement, which has the advantages associated with improved intake and discharge conditions, gives rise not only to a torque but also to a transverse force upon the intermediate disk because of the friction effect mentioned earlier.

The intermediate disk is supported to resist this torque and the transverse force in such a position that the intermediate disk remains freely retained between drum and housing and thus is not subject to deformation. In the construction of the invention, no compensating pistons are required to generate a transverse force and the angular adjustment of the intermediate disk can be accomplished in a simpler manner than has been the case in earlier drive-flange machines. In the latter, the cylinder drum bears against an intermediate element which has a cylindrical track in the housing to permit adjustment of the angle of tilt of the drum. The axis of this cylindrical track and the cylindrical surface of the element riding thereon coincides with the tilting axis of the drum, the fluid medium (for both intake and discharge) being conducted to the drum by recesses in this track through the intermediate element. Such a machine, in which an intermediate element is provided with two passages for the supply and discharge of the working fluid, is described in German open application No. DT-OS 2 313 575. In this machine, the center of curvature of the spherical surface lies along the axis of rotation of the cylinder drum.

In axial-piston machines according to the invention, each contact surface of the intermediate disk receives a hydraulic relieving force and a mechanical contact force. The locations and magnitudes of the hydraulic forces can be calculated from the centroids, dimensions and locations of the surfaces subjected to hydraulic pressure. The locations and magnitudes of the mechanical contact forces are determined by the force and moment equilibrium equations for the intermediate disk.

For a stable positioning of the intermediate disk it is required that the thus-calculated contact forces be positive and that they be effective within the bounds of the contact surfaces.

For the appropriate dimensions, for example the distance of the center of curvature from the axis of rotation of the drum and the direction in which this spacing lies (i.e. to which side of the rotation axis), it is possible to obtain values from the force-equilibrium and moment-equilibrium equations such that the mechanical contact forces are applied as much as possibly centrally to the contact surfaces.

The magnitudes of the two mechanical resultant forces are the respective differences between the reaction force of the presurized piston and the hydraulic relieving force upon the surface. The moment equilibrium about the center of the spherical surface is independent of the forces upon the spherical surface since their lines of action always run through the center of curvature. This the requisite distance of the center of curvature from the rotation axis is determined by the magnitudes and locations of the forces upon the planar control surface of the intermediate disk.

To ascertain the forces upon the spherical contact surface, the moment equilibrium about another point than that mentioned above must be considered. It is preferred to select as the reference point a point along the force line of action at its intersection with the spherical surface.

Because of the central application of the mechanical contact force, the location of the centroid of the pressurized-fluid field upon the surface can be easily determined. The aforedescribed basic calculations of the forces must be carried out for the average position of the piston force and the control-surface force. These forces change during operation continuously and are dependent upon the rotation of the drum, the number of cylinder bores which open over the separating webs against the control surface, the number which communicate with the high-pressure passage, and the number which discharge freely at the overhanging side of the drum at each instant. In machines having an uneven number of pistons (cylinder bores) n, the calculation is preferably made in the case in which only $(n-1)/2$ pistons are pressurized.

When the pistons under pressure are disposed symmetrically with respect to the plane of the cylinder drum axis perpendicular to a line connecting the dead-point positions, all forces lie in this plane. The center of curvature of the spherical surface is also in this plane or at least in the vicinity thereof.

The center-to-center distances from the center of curvature of the spherical surface yields, by the moment equilibrium, the control surface force at this point. At the control surface, the oil-pressure force $F_1$ is effective at center-to-center distance $l_1$ corresponding to the location of the centroid of the surface upon which the pressure is effective. The contact force $F_2$ is effective at the center-to-center distance $l_2$. $F_1$ and $l_1$ derive from the magnitude of the pressure field upon the control surface and the location of its centroid. The pressure-generated force in the pressure field around the passage openings in the gap can be approximated by considering it to extend substantially midway of the sealing web.

$F_2$ is given in relation to the sum of the piston forces $F_k$ by the relationship $F_2=F_k-F_1$. The center-to-center distance $l_2$ can be freely selected. Preferably, however, it is held small so that $F_2$ is applied centrally to the contact surface between the intermediate disk and the cylinder drum. Under these conditions, the center-to-center distance is determined by the relationship:

$$l_k=(l_1 \cdot F_1+l_2 \cdot F_2)/(F_1+F_2) \quad (1)$$

This equation applies only for planar-control surfaces in which all forces applied to the control-surface side are parallel to one another.

The radius of curvature of the spherical surfaces can also be freely selected within the parameters of the structural design. On the spherical contact surface between the intermediate disk, there is generated an oil-pressure force $F_3$ at a center-to-center distance $l_3$ and the contact force $F_4$ at a distance $l_4$. The contact force $F_4$ is so selected that the intermediate disk neither lifts from its track on the housing nor bears upon the cylinder drum with excessive friction. The distance $l_4$ is then selected such that $F_4$ is applied as close as possible to the centroid of the contact surface. The pressure field must then have the parameters which give values of $F_3$ and $l_3$ of the following values:

$$F_3=F_k-F_4 \quad (2)$$

$$l_3=(l_k \cdot F_k-F_4 \cdot l_4)/F_3 \quad (3)$$

It should be noted that the spherical surface, whose center of curvature lies offset from the axis of rotation of the drum, must always be disposed on the side of the housing at which the contact surfaces are provided. The other side of the cylinder drum can preferably overhang the intermediate disk.

However, it is also possible to shape the side of the intermediate disk turned toward the cylinder drum with a spherical curvature. In this case, however, the center of curvature of the spherical surface must lie between the intermediate disk and the cylinder drum along the axis of rotation of the latter. In this configuration, in which both sides of the intermediate disk have a spherically curved surface, similar relationships for the dimensioning of the spherically curved contact surface can be attained as were developed above using corresponding equations for the moment and force equilibrium.

The invention is also applicable to a drive-flange machine of the type in which the cylinder drum is swingable in a stationary housing and bears against an intermediate element which is shiftable along a curved track or surface in the housing, the center of curvature of this track lying at the tilting axis of the cylinder drum. In this case, the machine of the present invention can be constructed in one of several embodiments. For example, it is possible, in accordance with the principles of this invention, to provide the intermediate element of conventional construction with a cylindrical surface which rides along a cylindrical surface of the housing and to form the intermediate disk such that its spherical surface is eccentric with respect to the axis of rotation of the cylinder drum and engages a complementary surface of this intermediate element.

However, to avoid the expense for two separate elements between the housing and the cylinder drum, the intermediate element itself can constitute the intermediate disk directly, i.e. between the cylinder drum and the housing there is provided an intermediate element which not only serves to support the cylinder drum against the housing with freedom of movement into different angular positions, but also serves to function as the intermediate disk previously described. In this latter case, two embodiments can be considered, either this intermediate element is guided in a channel-shaped surface in the housing which has curvature in two different planes or the spherical surface can be so designed that its center of curvature lies adjacent the axis of rotation of the cylinder drum in the tilting axis of the device.

When the intermediate element has curvature in two different planes, the center of curvature in one plane should be such that this plane always lies parallel to the rotation axis of the shaft and drum while of the shaft and drum and goes through or includes the tilting axis of the cylinder drum while the curvature in the plane perpendicular thereto is in a plane perpendicular to the drum axis, the center of curvature of the latter surface lying at a smaller distance from the curved surface than the rotation axis of the drum.

The resulting surface is thus generally toroidal and can be fabricated without particular difficulty and cost.

The interior of the housing can be formed with a convexly curved surface which engages a complementary (concave) curved surface of the intermediate element.

If the intermediate disk is so shaped that the pressureless cylinders or the corresponding surface of the cylinder drum overhang the intermediate disk, the friction forces generate a torque upon the disk which should be compensated. It has been found, however, that no difficulties are encountered, in this connection, when the supporting forces are applied along radii of these spheroidal surfaces so that the resolved forces are all oppositely perpendicular to the force line of action mentioned previously or therealong.

BRIEF DESCRIPTION OF THE DRAWING

The above and other objects, features and advantages of the present invention will become more readily apparent from the following description, reference being made to the accompanying drawing in which the sole FIGURE is a partial cross-sectional view through an axial-piston machine embodying the present invention.

SPECIFIC DESCRIPTION

The machine shown in the sole FIGURE of the drawing is a so-called drive-flange machine, operable as a pump, which has a drive shaft 1 formed with the drive flange 2 which receives the ball heads 4 of a plurality of angularly equispaced piston rods 3, each of which is formed with a piston 5 slidable in a respective cylinder bore in a cylinder drum 7. Each cylinder bore 6 opens via a passage 8 along the end face of the cylinder drum 7.

The cylinder drum 7 is rotatably journaled upon a central shaft or pin 10 which, in turn, has a ball head 11 rotatably received in a corresponding socket along the axis of the drive shaft 1 in the flange 2. The ball head 11 has its center in the same plane as the centers of the ball heads 4.

The shaft 10 is journaled, in addition, in a bearing sleeve 12 in a housing portion 13 which is rigid with the swingable housing 14 by which the drum is tilted to adjust the output of the machine. A high-pressure passage 18 is formed in the housing and communicates via an arcuate groove or slot in a control or intermediate plate 15 with the passages 8.

On the opposite side of the drum, the surface 9 overhangs the control or intermediate plate 15 so that the passages 8 open freely into the housing space surrounding the drum.

The intermediate plate 15 is disposed between the planar end face 9 of drum 7 and the housing portion 13 on the side of the latter only upon which the high-pressure duct 18 is provided. The surface 16 between the housing portion 13 and the intermediate disk 15 is spherically curved and is convex to ride upon a spherical surface which is concave and complementary thereto formed on the housing part 13.

The center of curvature of the surface 16 and the corresponding supporting surface of the housing is spaced from the axis of the pin 10 and the rotation axis of the drum 7 to the side thereof at which the plate 15 is disposed. This center of curvature is represented at 20 in the drawing.

A spring 17 bears against a seat **18*a* of the pin 10 and also abuts an inwardly directed shoulder of the drum 7 to urge the drum 7 downwardly against the intermediate disk 15 and to retain the same against the housing portion 13**.

The central pin 10 is also provided with a shoulder 19 which abuts the upper end face of the drum 7 inwardly of the pistons and limits the degree to which the drum 7 and the disk 15 can move away from the housing portion 13 to an extremely small degree.

The invention, in addition to comprehending the systems described, also includes the following combinations of features:

(a) An axial-piston machine with a rotating cylinder drum and an intermediate disk between the latter and a housing portion having at least one fluid passage.

(b) The intermediate disk has, at least along its surface turned toward the housing, a spherical surface which rests against a corresponding spherical countersurface of the housing.

(c) The center of curvature of the latter spherical surfaces are disposed to one side of the axis of rotation of the cylinder drum, preferably the side to which the disk is disposed.

(d) Always the same side of the cylinder drum is charged with fluid at high pressure while the opposite side of the cylinder drum always is at low pressure.

(e) The invention also comprehends the use of an intermediate disk with at least one spherical surface in an axial-piston machine which always has its cylinder drum charged on one side with high pressure while the other side of the cylinder drum is always at low pressure.

In this case, the center of curvature of the spherical surface is disposed outside of the rotation axis to the side thereof which corresponds to the high-pressure side.

That housing chamber into which the low-pressure side of the drum discharges or from which the low-pressure side of the drum draws fluid can communicate with or correspond to a tank or reservoir for the fluid.

We claim:

1. An axial-piston machine which comprises:

a housing;

a cylinder drum rotatable in said housing and provided with a plurality of angularly spaced cylinder bores each of which receives a respective reciprocatable piston;

a reaction surface inclinable relative to the axis of said drum and engaging said pistons, said drum having an end face opposite said reaction surface;

an intermediate disk between said face of said drum and said housing and formed at least on its side turned toward said housing with a spherical contact surface engaging a counter surface of said housing; and means for pressurizing only one side of said drum through at least one passage formed in said disk, said contact surface having its center of curvature offset from the axis of said drum to the side thereof maintained under high pressure, said face of said drum overhanging beyond said disk at the side of said drum opposite said side maintained at high pressure whereby said cylinder bores discharge freely from the overhanging face of said drum into or draws fluid freely from a space provided in said housing around said drum.

2. The axial-piston machine defined in claim 1 wherein said contact surface is convex in the direction of said housing.

3. The axial-piston machine defined in claim 1 further comprising abutment means restricting the movement of said durm and said disk away from said counter surface of said housing.

4. The axial-piston machine defined in claim 1 wherein the center of curvature of said contact surface lies in a plane through the axis of said drum and perpendicular to a plane through a pair of separating webs of a reversing device for said machine.

5. The axial-piston machine defined in claim 1 wherein said disk has a planar contact surface engaging said face of said drum.

6. The machine defined in claim 5 wherein a fluid medium is fed to said drum through a passage traversing said disk and subjecting said spherical surface to a pressure field whose centroid is disposed substantially along the force line of action applied by said drum against said disk.

7. In a drive-flange axial-piston machine having a cylinder drum and a housing, the improvement wherein only one side said drum is subjected to elevated pressure while an opposite side of said drum is always at low pressure, the improvement which comprises an intermediate element between said drum and a housing in which said drum is rotatable, said element having a continuously curved surface riding along a correspondingly curved countersurface of said housing whose axis lies along a tilting axis of said drum, said intermediate element being a disk disposed only on the side of said drum subjected to high pressure, the low pressure side of said drum overhanging beyond disk.

8. The improvement defined in claim 7 wherein said intermediate element is a disk disposed only on the side of said drum subjected to high pressure, the low pressure side of said drum overhanging said disk.

9. The improvement defined in claim 7 wherein said intermediate element is formed as a single piece and has a spherically curved surface with a center of curvature lying near the axis of rotation of the cylinder drum in a tilting axis therefor.

10. The improvement defined in claim 8 wherein the countersurface of said housing engaging the surface of said element is convexly curved.

11. The improvement defined in claim 10 wherein said intermediate element is formed with a spherically concave surface and with an intermediate disk having a spherically convex surface received in and complementary of said spherically concave surface, said spherically convex and concave surfaces having a center of curvature offset from the axis of rotation of said drum and lying approximately in a plane perpendicular to said axis of rotation and a tilting axis of said drum.

* * * * *